US006712624B2

(12) United States Patent
Hashimoto

(10) Patent No.: US 6,712,624 B2
(45) Date of Patent: Mar. 30, 2004

(54) BOARD MOUNTABLE CONNECTOR AND BOARD MOUNTING STRUCTURE OF CONNECTOR

(75) Inventor: Shinichi Hashimoto, Kanagawa (JP)

(73) Assignee: Tyco Electronics AMP, K.K., Kanagawa (JP)

( * ) Notice: Subject to any disclaimer, the term of this patent is extended or adjusted under 35 U.S.C. 154(b) by 123 days.

(21) Appl. No.: 10/016,102

(22) Filed: Nov. 2, 2001

(65) Prior Publication Data

US 2002/0052131 A1 May 2, 2002

(30) Foreign Application Priority Data

Nov. 2, 2000 (JP) ..... 2000-336234

(51) Int. Cl.[7] ..... H01R 9/09
(52) U.S. Cl. ..... 439/79; 439/633
(58) Field of Search ..... 439/59, 79, 80, 439/633, 680

(56) References Cited

U.S. PATENT DOCUMENTS 5,277,611 A * 1/1994 Berek et al. ..... 439/59
5,336,117 A * 8/1994 Mizuguchi et al. ..... 439/79
5,743,751 A * 4/1998 Davis et al. ..... 439/79
6,000,954 A * 12/1999 Medina et al. ..... 439/79
6,068,501 A * 5/2000 Knighton et al. ..... 439/80
6,128,200 A * 10/2000 Chu ..... 439/59
6,338,631 B1 * 1/2002 Hashimoto et al. ..... 439/79
6,358,067 B1 * 3/2002 Takase et al. ..... 439/79

FOREIGN PATENT DOCUMENTS

JP 10-134909 5/1998 ..... H01R/23/68

* cited by examiner

*Primary Examiner*—Neil Abrams
*Assistant Examiner*—Thanh-Tam Le

(57) ABSTRACT

A board mountable connector has a pair of mounting portions to be mounted on a board. A mounting aperture is formed in each mounting portion, and a keying protrusion is formed on one of the pair and aligned with the mounting aperture. A pair of openings, corresponding to the mounting apertures in the mounting portions of the connector, are provided in the board. A slot that receives the keying protrusion is aligned with one of the openings. This slot is formed thin, to correspond to the keying protrusion of the mounting portion. The mounting portion serves as a securing means by a bolt as well as a keying means to prevent erroneous mounting. Connector retention is therefore improved while minimizing the area required on the board.

14 Claims, 6 Drawing Sheets

BOARD MOUNTABLE CONNECTOR AND BOARD MOUNTING STRUCTURE OF CONNECTOR

FIELD OF THE INVENTION

The present invention relates to board mountable connectors and more particularly, to a mounting structure having keying features to be mounted on an edge of a board.

BACKGROUND OF THE INVENTION

Board mountable connectors are known for example as disclosed in Japanese Unexamined Patent Publication Number 10(1998)-134909. The connector of the above patent application comprises a plurality of gripper arm pairs, and the connector is secured to a circuit board by having an edge of the circuit board received in a receiving space formed by these gripper arms. To improve retention of the connector on the board, crush ribs are formed on the gripper arms.

In this example, the connector and the circuit board are secured by frictional engagement. Accordingly, as it is not a permanent securing means because, after use over a long period of time, the securing members may loosen. Further, in the case that the connector is intended to be provided with a keying mechanism, additional ribs that mate with the circuit board in a concave or convex manner are generally provided. In this case, it becomes necessary to provide additional space in the mounting area of the circuit board for the keying mechanism, making the mounting foot print larger. Additionally, when the connector has been mounted erroneously and needs to be removed and remounted, the crush ribs may have been permanently deformed during the first mounting preventing them from securing the connector during the remounting.

SUMMARY OF THE INVENTION

The present invention has been developed in view of the above problems, and it is an object of the present invention to provide a board mountable connector having a high retention strength, while minimizing the required mounting area on the circuit board for mounting a keying mechanism.

This and other objects are achieved by providing a board mountable connector having an insulative housing having a plurality of contacts, a pair of mounting portions, to be mounted near an edge of a circuit board. The circuit has a pair of openings for receiving the mounting portions. Each of the mounting portions is provided with a mounting aperture to be penetrated by a bolt for securing the insulative housing the openings in the circuit board. One of the pair of mounting portions is formed with a keying protrusion on a contact surface that contacts the circuit board to engage a slot provided at one of the openings.

BRIEF DESCRIPTION OF THE DRAWINGS

The invention will now be described by way of example with reference to the accompanying figures of which.

DETAILED DESCRIPTION OF THE PREFERRED EMBODIMENT

Figure 1:
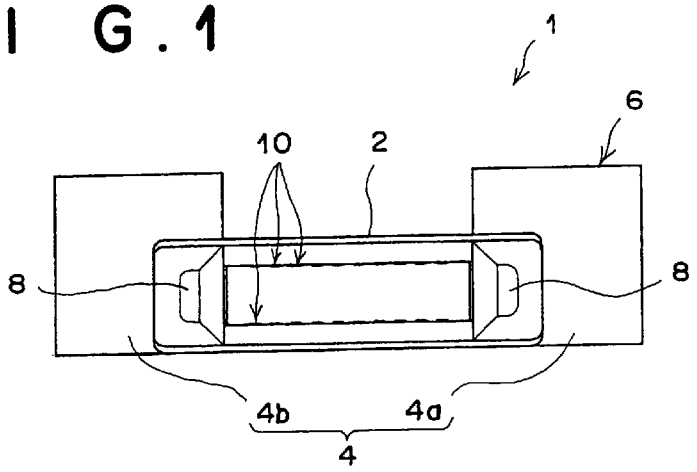
FIG. 1 is a front view of the board mountable connector according to a first embodiment of the present invention.

The connector according to the first embodiment will now be described with reference to FIGS. 1 through 6. The connector 1 comprises an insulative housing hereinafter referred to as a housing 6, formed integrally by an insulative synthetic material having a plurality of contacts 10 positioned therein. The housing 6 has a generally flattened substantially rectangular main body 2 and a rectangular mounting portion 4 on each side of the rear portion of the main body 2. Pointed protrusions 8 are formed at both sides of the front end or mating portion of the connector 1. These protrusions 8 act as guides when connector 1 mates with another connector (not shown).

Figure 3:
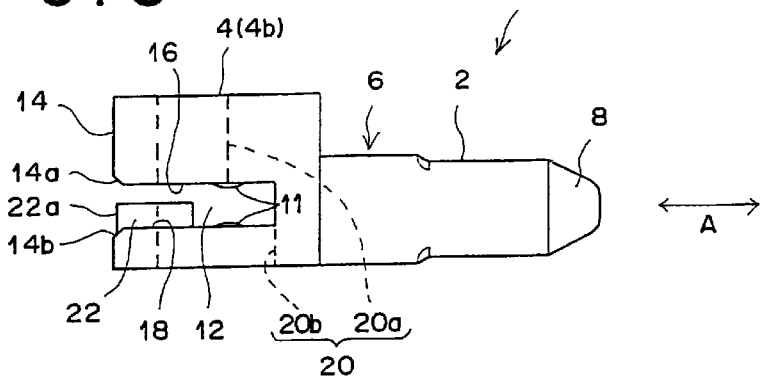
FIG. 3 is a left side view of the board mountable connector of FIG. 1.
Figure 4:
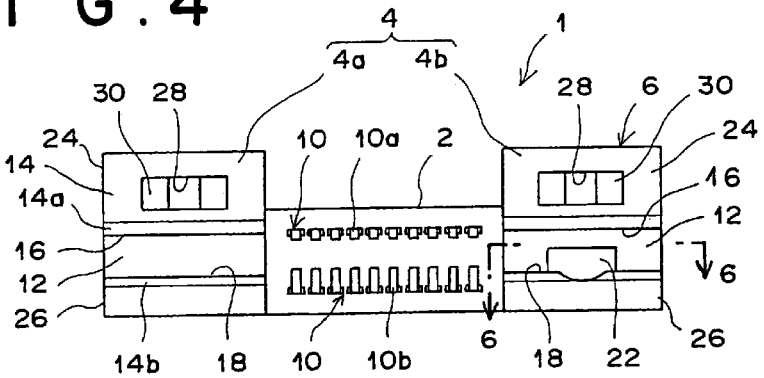
FIG. 4 is a rear view of the board mountable connector of FIG. 1.
Figure 7:
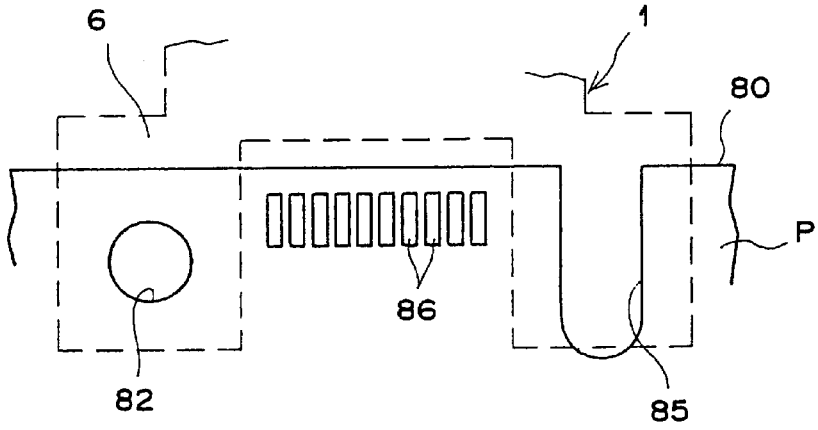
FIG. 7 is a partial schematic view of a board and the board mountable connector of the first embodiment to be mounted thereon.

Contacts 10 are formed so that their board contact sections 10*a*, 10*b* (see FIG. 4) protrude from the rear portion of main body 2 of housing 6 to be connected to a board P (see FIG. 7). These board contact sections 10*a*, 10*b* are arranged such that they are disposed in upper and lower rows, as shown in FIG. 4 so that the board P is received in between the rows. In addition, each of the board contact sections 10*a*, 10*b* are formed with a bight portion 11 protruding towards the board side to contact the board P (see FIG. 3).

The mounting portions 4 are formed of a pair of mounting portions 4*a*, 4*b*. As best shown in FIG. 3, board receiving grooves 12, are formed in the mounting portions 4. The grooves 12 are located so that the board P is positioned in between the rows of board contact sections 10*a*, 10*b* that extend out of the rear portion of main body 2 (see FIG. 4). Tapered surfaces 14*a*, 14*b* are formed at portions of the grooves 12 where they open at the rear end surfaces 14 of the mounting portions 4, to facilitate the insertion of board P. The opposing surfaces of the grooves 12 are contact surfaces 16, 18, that contact and hold the board P when it is inserted into the grooves 12.

Each of the mounting portions 4 is provided with a mounting aperture 20 that penetrates the two opposing contact surfaces 16, 18. That is, the mounting apertures 20 are formed to penetrate upper portions 24 of the mounting portions 4 above the grooves 12 as well as lower portions 26 below the grooves 12. The mounting apertures 20 are generally circular apertures 20*a* provided in the upper portions 24 and generally oblong mounting apertures 20*b* having semicircular inner edges (see FIG. 5). The oblong shape of the mounting aperture 20*b* is formed by a pin in molding die being positioned at that location during the manufacturing process of integral formation of the mounting aperture 20*b*. Note that in each of the embodiments, the mounting apertures as a whole are referred to as mounting aperture 20.

A keying protrusion 22 is integrally formed on the contact face 18 of the mounting portion 4*b*. The keying protrusion 22 extends from the mounting aperture 20 towards the rear end surface 14 (see FIGS. 3 and 5) of the connector 1. The keying protrusion 22 is formed on the mounting portion 4*b*. The keying protrusion 22 is of approximately the same width as the diameter of the mounting aperture 20, and the tip 22*a* is formed in an arc shape to facilitate engagement with the board P (see FIG. 5). The shapes of the ridge 22 and the oblong mounting aperture 20*b*, as well as their relative positions, are clearly shown in FIG. 6.

Figure 2:
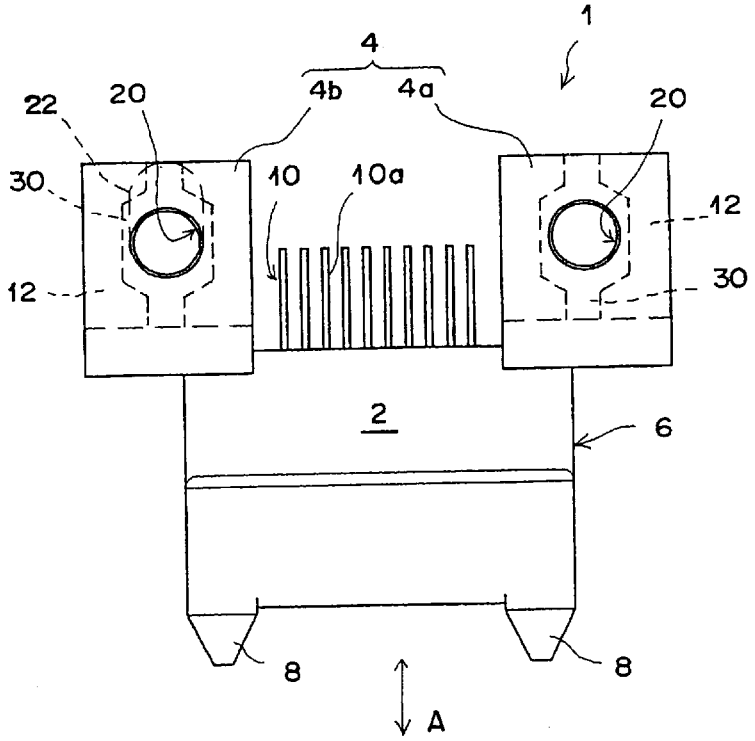
FIG. 2 is a plan view of the board mountable connector of FIG. 1.

As shown in FIG. 4, recesses 28 are formed in the upper portions 24 of the mounting portions 4. Nuts 30 are press-fitted within the recesses 28 (see FIG. 2, FIG. 4). These nuts 30 threadably mate with bolts (not shown) inserted from a lower side as shown in FIG. 4 to secure the connector 1 on the board P. The nuts 30, as best shown in FIG. 2, are approximately octagonal in shape. When the nuts 30 are press-fitted to a predetermined position, threaded apertures 30*a* of the nuts 30 become concentric with the mounting aperture 20*a*.

Next, the board P, on which the connector 1 is to be mounted, will be described with reference to FIG. 7. FIG. 7 is a partial schematic view of the board P and a portion of connector 1 in accordance with the first embodiment to be mounted thereon. Note that connector 1 is shown by a broken line in the figure. In the vicinity of the edge 80 of the board P are formed openings 82, 85 that are in positions corresponding to the mounting apertures 20 of connector 1. The opening 82 is circular in shape, while the opening 85 is formed as a slot having a width equal to the diameter of the opening 82, extending in a direction perpendicular to the edge 80 and opening thereto.

To mount the connector 1 to the board P, the keying protrusion 22 is aligned with the opening 85, and the connector 1 is mounted onto the board P in a manner so as to insert the edge 80 into the grooves 12. At this point, the keying protrusion 22 is guided by the inner edge of the slot 85 as it enters the slot 85. When the connector 1 reaches a predetermined position in relation to the board P, the opening 82, the slot 85, and the mounting apertures 20 become aligned. At this point it becomes possible to secure the connector 1 to the board P by inserting the bolts from a lower side as shown in FIG. 3 and FIG. 4. If the mounting of the connector 1 is attempted erroneously, e.g., while it is upside down, the keying protrusion 22 does not enter slot 85. Rather, as the keying protrusion 22 would be positioned on the side of opening 82, the edge 80 of board P will interfere therewith, preventing the insertion of board P into the grooves 12. A plurality of conductive pads 86 are formed on both sides of the board P along its edge 80, between the opening 82 and the slot 85. The conductive pads 86 are connected to the board contact sections 10*a*, 10*b* of the contacts 10. More specifically, the bight portions 11 of the board contact sections 10*a*, 10*b* are connected to the conductive pads 86.

Figure 8:
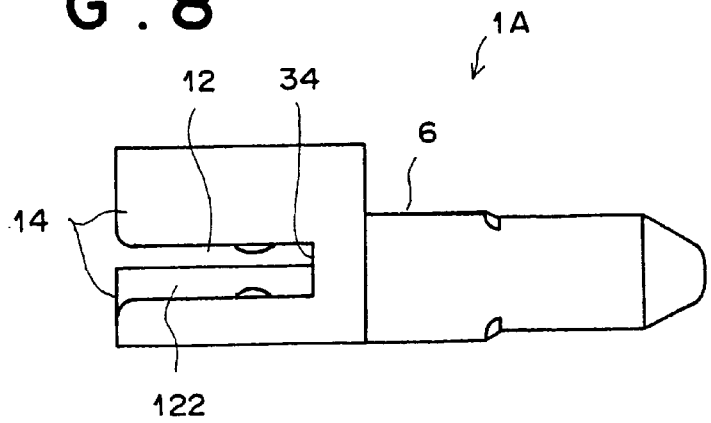
FIG. 8 is a left side view of a board mountable connector according to a second embodiment of the present invention.
Figure 9:
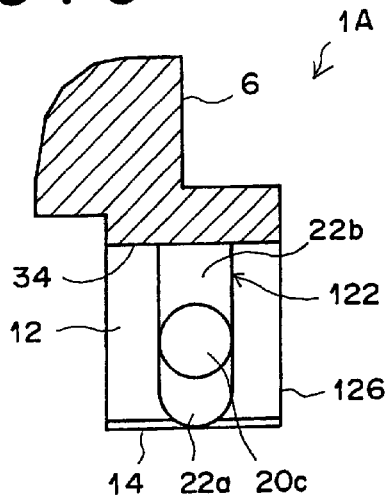
FIG. 9 is a partial cross section showing the planar shape of the keying protrusion of FIG. 8.

Next, a connector according to a second embodiment of the present invention will be described with reference to FIG. 8 and FIG. 9. Note that elements that are the same as those in the first embodiment have been assigned the same reference numerals. The connector 1A has a longer keying protrusion than connector 1. Mounting aperture 20*c* of a lower portion 126 is formed circular, similar to a mounting aperture 20*a*. A portion that extends from the mounting aperture 20*c* to the rear end surface 14 is formed as a keying protrusion 22*a* having the same shape as the keying protrusion 22. However, a ridge 22*b*, of the same width as the keying protrusion 22*a*, is integrally formed on an inner side of a groove 12, the keying protrusion 22*a* and ridge 22*b* form as a whole, a long keying protrusion 122 that extends as a whole from the rear end surface 14 to the interior wall 34 of the groove 12. In this case, when the long keying protrusion 122 enters a slot 85, its length allows improved guidance and alignment during mating. In addition, because the mounting apertures 20 are circular, the positioning of the housing 6 becomes more accurate. Thereby, soldering paste on the conductive pads 86 is not disturbed by the board contact sections 10*a*.

Figure 10:
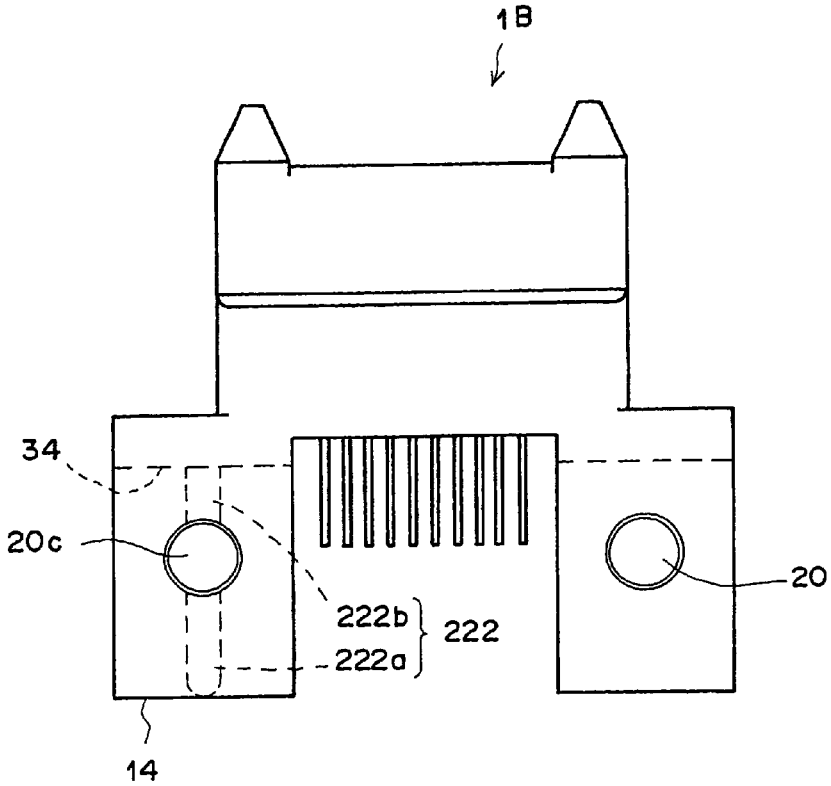
FIG. 10 is a bottom view of a board mountable connector according to a third embodiment of the present invention.
Figure 11:
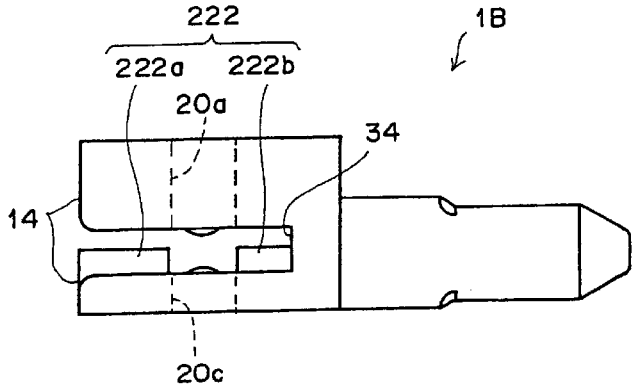
FIG. 11 is a left side view of the board mountable connector of the third embodiment of the present invention.
Figure 12:
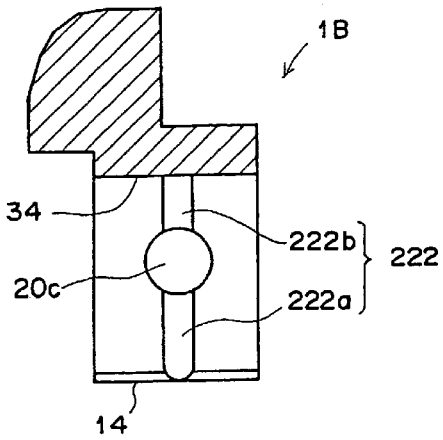
FIG. 12 is a partial cross section showing the planar shape of the keying protrusion of the board mountable connector shown in FIG. 10.

Next, a connector according to a third embodiment of the present invention will be described with reference to FIG. 10 through 12. The connector according to the third embodiment has a keying protrusion having a width thinner than the mounting apertures 20. The keying protrusion 222 that extends in an insertion direction A on both sides of a mounting aperture 20*c* is thinner than the keying protrusion 122 described above. The keying protrusion 222 comprises a rear portion 222*a* that extends towards the rear end surface 14, and a front portion 222*b* that extends towards the inner wall 34. The keying protrusion 222 is aligned with the mounting aperture 20*c*, and is divided at the mounting aperture 20*c* of the connector 1B.

Figure 13:
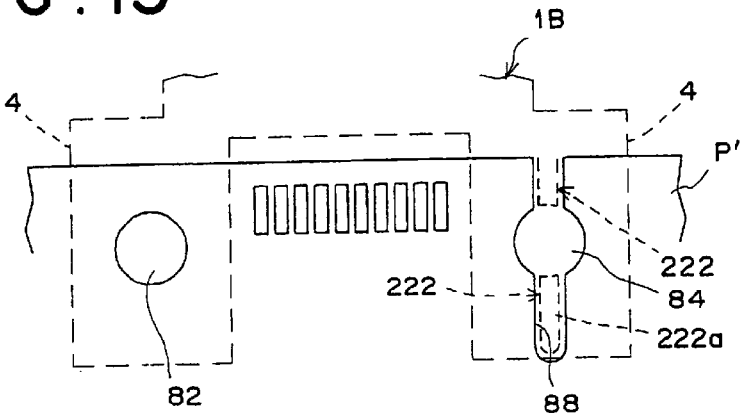
FIG. 13 is a partial schematic view of a board and the board mountable connector of the third embodiment to be mounted thereon.

Next, the relative positions of the connector 1B and a board P during mounting will be described with reference to FIG. 13. The board P is provided with openings 82 and 84 in positions corresponding to mounting apertures 20. A slot 88 is aligned with opening 84. This slot 88 is formed to be complimentary with the keying protrusion 222. When the connector 1B is to be mounted onto the board P, the keying protrusion 222 is guided by, and enters, slot 88 as described above. Because as the rear portion 222*a* of the keying protrusion 222 is longer than the diameter of the opening 84, shifting of the rear portion 222*a* within the opening 84 during insertion is prevented. Accordingly, smooth installation and accurate positioning of the connector 1B is ensured.

Figure 5:
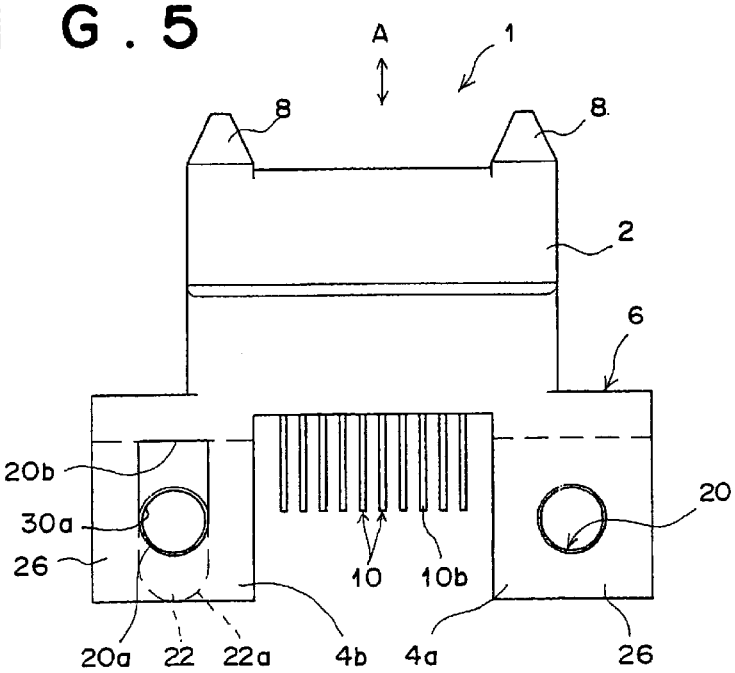
FIG. 5 is a bottom view of the board mountable connector of FIG. 1.
Figure 6:
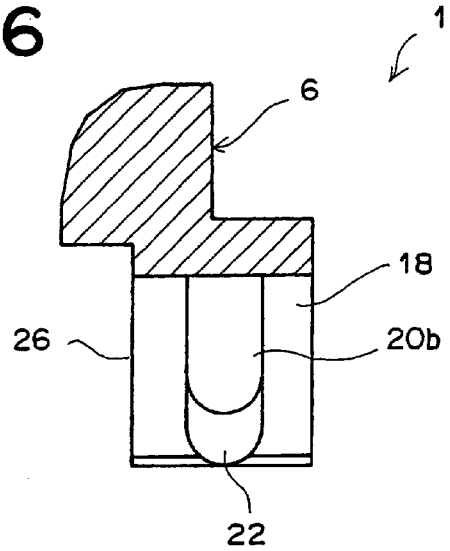
FIG. 6 is a partial cross section of the mounting member, taken along the line 6—6 of FIG. 4.
Figure 14:
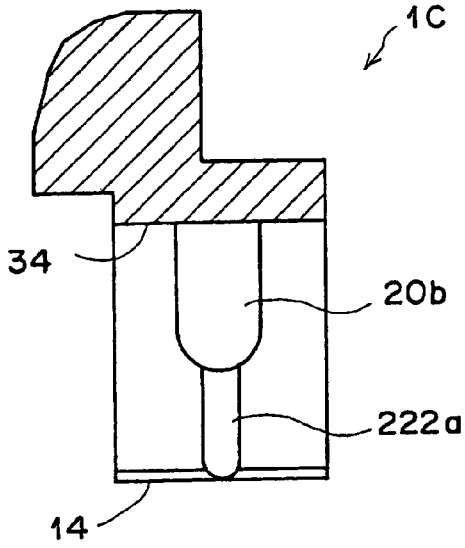
FIG. 14 is a partial cross section showing a portion of the board mountable connector according to a fourth embodiment of the present invention.

Next, an alternate embodiment of the thin keying protrusion in a connector 1C according to a fourth embodiment of the present invention will be described with reference to FIG. 14. The connector 1C of this embodiment is a combination of the mounting aperture 20*b* of the first embodiment and a portion of the thin keying protrusion 222 of the third embodiment. The structure of the connector 1C combines the oblong mounting aperture 20*b* that extends to the inner wall 34 as shown in FIG. 5 and the rear portion 222*a* of the keying protrusion 222 that extends from the edge of the mounting aperture 20*b* to the rear end surface 14, as shown in FIG. 12. The connector 1C is also mounted on the same board P. As the rear portion 222*a* is longer than the diameter of the opening 84 as in the previous embodiment, similar improvements in guiding and positioning accuracy are obtained. In the fourth embodiment, as the mounting aperture 20*b* is an oblong aperture and there is no protrusion formed on a forward portion thereof, the structure of the molding dies are relatively simplified.

Because the board mountable connector according to the present invention is provided with mounting apertures for receiving the bolt, while one of the pair of mounting portions is provided with the keying protrusion on the contact surface thereof, the retention strength is improved due to the use of bolts, while the mounting space required can be minimized due to the combination of the keying member and the mounting member.

Where the mounting portions have grooves for receiving the circuit board, the mounting apertures are formed to penetrate the pairs of opposing surfaces that define the grooves. The keying protrusion is formed as a protrusion that extends in a mounting direction of the insulative housing to the circuit board on a contact surface which is one of the opposing surfaces that define one of the grooves aligned with the mounting aperture. The retention strength is therefore further improved due to the groove and mounting portions, while the required mounting area can be further minimized due to the mounting aperture and the keying protrusion being formed at the same position. In addition, the connector may be smoothly mounted onto the circuit board because the keying protrusion formed as a ridge that extends in a mounting direction of the insulative housing to the circuit board acts as a guide when the connector is mounted onto the circuit board.

If the keying protrusion is formed so that its width is thinner than the mounting aperture and its length is longer than the diameter of the opening of the circuit board, the guide function during the mounting operation can be further improved, thereby improving the reliability of the electrical connection.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A board mountable connector comprising:

an insulative housing having a pair of mounting portions to be mounted to an edge of a circuit board having a pair of openings;

a plurality of contacts positioned in the housing;

each of the mounting portions having a mounting aperture for receiving a fastener for securing the insulative housing to the openings; and, a keying protrusion located on a contact surface of at least one of the mounting portions that contacts the circuit board to engage a slot provided in one of the openings.

2. A board mountable connector as defined in claim 1, wherein the mounting portions have grooves that receive the circuit board.

3. A board mountable connector as defined in claim 2, wherein the mounting apertures are formed to penetrate pairs of opposing surfaces that define the grooves.

4. A board mountable connector as defined in claim 3, wherein the keying protrusion is formed as a ridge that extends in a mounting direction of the insulative housing to the circuit board on the contact surface which is one of the opposing surfaces that define one of the grooves, aligned with the mounting aperture.

5. A board mountable connector as defined in claim 4, wherein the keying protrusion is formed such that its width is thinner than the mounting aperture and its length is longer than the diameter of one of the openings of the circuit board.

6. A board mounting structure for mounting a board mountable connector, having an insulative housing and a plurality of contacts disposed in the housing, to a circuit board, the structure comprising:

the insulative housing being provided with a pair of mounting portions, each having a mounting aperture for receiving a bolt;

the circuit board having a pair of openings corresponding in position to the mounting apertures and a slot in one of the pair of openings a keying protrusion located on at least one of the contact surfaces of at least one of the mounting portions that contact the circuit board to engage the slot.

7. A board mounting structure for mounting a board mountable connector as defined in claim 6 wherein the mounting portions have grooves that receive the circuit board.

8. A board mounting structure for mounting a board mountable connector as defined in claim 7 wherein the grooves are defined by pairs of opposing surfaces, and the mounting apertures are formed to penetrate the pairs of opposing surfaces that define the grooves.

9. A board mounting structure for mounting a board mountable connector as defined in claim 8 wherein the keying protrusion is formed as a ridge that extends in a mounting direction of the insulative housing to the circuit board on the contact surface which is one of the opposing surfaces that define one of the grooves, aligned with the mounting aperture in the mounting direction.

10. A board mounting structure for mounting a board mountable connector as defined in claim 9 wherein the keying protrusion is formed such that its width is thinner than the mounting aperture.

11. A board mounting structure for mounting a board mountable connector as defined in claim 10 wherein the slot of the circuit board is also formed thin and aligned with one of the openings thereof to correspond to the keying protrusion.

12. A board mounting structure for mounting a board mountable connector as defined in claim 11 wherein the keying protrusion is formed such that its length is longer than the diameter of the opening corresponding to the keying protrusion.

13. A board mounting structure for mounting a board mountable connector as defined in claim 6 wherein the slot forms one of the pair of openings.

14. A board mountable connector comprising:

an insulative housing having a pair of mounting portions formed at both sides of a main body, each of the mounting portions having a board receiving groove therein defined by opposing contact surfaces configured to contact a circuit board and a mounting aperture for receiving a fastener transverse the board receiving groove;

a plurality of contacts positioned in the main body; and a keying protrusion located on at least one of the contact surfaces of at least one of the mounting portions, the keying protrusion having the mounting aperture passing therethrough and being engagable with a slot that including an opening formed in the circuit board for receiving the fastener.

* * * * *